US005098748A

United States Patent [19]

Shimizu et al.

[11] Patent Number: 5,098,748

[45] Date of Patent: Mar. 24, 1992

[54] METHOD OF PRODUCING A FLAME-SPRAY-COATED ARTICLE AND FLAME SPRAYING POWDER

[75] Inventors: Tsutomu Shimizu; Yasuhumi Kawado; Koji Yagii, all of Hiroshima, Japan

[73] Assignee: Mazda Motor Corporation, Hiroshima, Japan

[21] Appl. No.: 680,780

[22] Filed: Apr. 3, 1991

Related U.S. Application Data

[63] Continuation of Ser. No. 303,238, Jan. 30, 1989, abandoned.

[30] Foreign Application Priority Data

Jan. 29, 1988 [JP] Japan ..... 63-18879

[51] Int. Cl.[5] ..... B05D 1/08

[52] U.S. Cl. ..... 427/423; 106/1.12; 106/1.27; 106/403; 106/453; 427/190; 427/191; 427/201; 427/217

[58] Field of Search ..... 427/423, 190, 191, 201, 427/217; 106/1.12, 1.27, 403, 453

*Primary Examiner*—Bernard Pianalto

*Attorney, Agent, or Firm*—Sixbey, Friedman, Leedom and Ferguson

[57] ABSTRACT

Powder which has primary particle size of not larger than 10 μm and is formed of mixture of Ni powder and Cr powder added with hard particles containing carbide is mixed with $Cr_3C_2$ powder and granulated and sintered, whereby flame spraying powder having secondary particle size of 5 to 53 μm is formed. The flame spraying powder thus formed is flame-sprayed under conditions which will cause fused Ni.Cr to cover $Cr_3C_2$ particles which are not fused, thereby binding the $Cr_3C_2$ particles and causes the thickness of one Ni.Cr layer to be smaller than 5 μm. In this manner, flame spray coating the porosity of which is not larger than 2% and the hardness of which is not lower than 700 (Hv: 200 g) can be obtained.

8 Claims, 2 Drawing Sheets

METHOD OF PRODUCING A FLAME-SPRAY-COATED ARTICLE AND FLAME SPRAYING POWDER

This application is a continuation of Ser. No. 07/303,238, filed Jan. 30, 1989, now abandoned.

BACKGROUND OF THE INVENTION

1. Field of the Invention

This invention relates to an article provided with flame spray coating for increasing wear resistance and/or strength, and a method of producing a flamespray-coated article and flame spraying powder.

2. Description of the Prior Art

Recently, an internal combustion engine such as for a vehicle comes to be formed of a light alloy such as an aluminum alloy in order to lighten the engine. However, since light alloys are generally inferior in mechanical strength such as wear resistance, sliding surfaces are generally provided with flame spray coating of a hard metal, a ceramic or the like in order to improve durability.

For example, it has been proposed to provide a flame spray coating of high-carbon steel and molybdenum on the seal sliding surfaces on which the side seals, the corner seals and the oil seals mounted on the rotor of a Wankel engine slide as disclosed in Japanese Utility Model Publication No. 46(1971)-20083 and the like.

As flame spraying powder which can form flame spray coating at low cost, there has been known powder of $Cr_3C_2$. However, if $Cr_3C_2$ powder is flamesprayed by itself, good coating cannot be obtained. In order to overcome the problem, there has been proposed flame spray coating powder obtained by adding 15–50 wt % Ni-Cr alloy (including 20% Cr) to $Cr_3C_2$ powder.

In the powder, Ni.Cr functions as binder and hard coating of $Cr_3C_2$ is formed. The powder is obtained by mixing $Cr_3C_2$ powder with ground Ni-Cr alloy. As the particle size of the Ni-Cr alloy powder becomes smaller, the contact area of the Ni-Cr alloy particles with the $Cr_3C_2$ particles is increased and the binding power of the Ni-Cr alloy is increased, whereby film properties (hardness, binding power, porosity) become better.

However, due to high ductility and malleability of Ni.Cr and Ni-Cr alloy, Ni-Cr alloy is apt to be ground into flaky pieces and cannot be ground into fine particles. Accordingly, it has been very difficult to obtain fine particles adapted to form flame spray coating having excellent film properties at acceptable cost.

SUMMARY OF THE INVENTION

In view of the foregoing observations and description, the primary object of the present invention is to provide an article which is provided with a flame spray coating having excellent film properties and can be produced at low cost.

Another object of the present invention is to provide a method of producing an article which is provided with a flame spray coating having excellent film properties.

Still another object of the present invention is to provide a method of producing flame spray coating powder which is adapted to form flame spray coating having excellent film properties.

In accordance with the present invention, Ni-Cr powder having primary particle size not larger than 10 μm which could not be produced is produced by grinding a mixture obtained by adding hard particles containing carbide (e.g.$Cr_3C_2$) to Ni powder and Cr powder. Secondary particles which contains the Ni-Cr powder thus obtained and contains $Cr_3C_2$ as the major component are flame sprayed under predetermined conditions.

More particularly, powder which has primary particle size of not larger than 10 μm and is formed of mixture of Ni powder and Cr powder added with hard particles containing carbide (e.g.$Cr_3C_2$) is mixed with $Cr_3C_2$ powder and granulated and sintered, whereby flame spraying powder having secondary particle size of 5 to 53 μm is formed. The flame spraying powder thus formed is flame-sprayed under conditions which will cause fused Ni.Cr to cover $Cr_3C_2$ particles which are not fused, thereby binding the $Cr_3C_2$ particles and causes the thickness of one Ni.Cr layer to be smaller than 5 μm. In this manner, flame spray coating the porosity of which is not larger than 2% and the hardness of which is not lower than 700 (Hv:200 g) can be obtained.

By adding the mixture of the Ni powder and the Cr powder with hard particles containing carbide, the Ni particles and the Cr particles can be easily fined and primary particles having particle size of not larger than 10 μm can be obtained in a short time. As described above, as the particle size of the Ni-Cr powder becomes smaller, the contact area of the Ni-Cr particles with the $Cr_3C_2$ particles is increased and the binding power of the Ni-Cr alloy is increased, whereby film properties (hardness, binding power, porosity) become better. For this purpose, the primary particle size should be not larger than 10 μm.

Preferably the Ni powder and the Cr powder be in the ratio of 4:1. Though the resistance to oxidation at high temperatures can be improved by addition of Cr, fine grinding becomes difficult when proportion of Cr is not smaller than 20%. Further, it is preferred that the primary particle powder be mixed with $Cr_3C_2$ powder in the ratio of 15 to 40 wt %. When the primary particle powder is less than 15 wt %, binding powder becomes poor and the value of BET and the porosity are increased, whereby wear rersistance is deteriorated. Further, when the primary particle powder is more than 40 wt %, the hardness of the flame spray coating layer is lowered and the wear resistance is deteriorated.

When the thickness of the Ni.Cr layer is larger than 5 μm, the contact area with $Cr_3C_2$ particles is reduced by the degree corresponding to increase in thickness of the Ni-Cr layer, whereby binding power becomes poor and the porosity and the hardness are adversely affected.

By providing the seal sliding surface of the Wankel engine with flame spray coating by use of the flame spray coating powder in accordance with the present invention, there can be obtained a coating which is not larger than 2% in porosity, not lower than 750 (Hv:200 g) and which exhibits the rate in reduction of the volume not larger than 50 $mm^3$.

DESCRIPTION OF THE PREFERRED EMBODIMENTS

Figure 1:
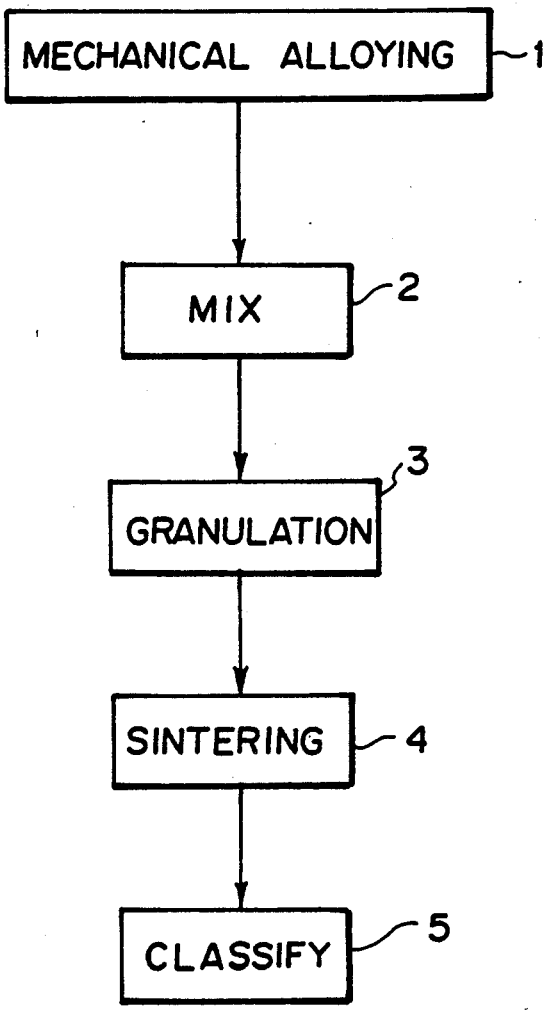
FIG. 1 is a view showing munufacturing steps of flame spray coating powder in accordance with an embodiment of the present invention.

FIG. 1 shows a method of producing flame spray coating powder in accordance with an embodiment of the present invention.

The method comprises a mechanical alloying step 1 in which $Cr_3C_2$ particles (hard particles containing carbide) are added to Ni powder and Cr powder and the mixture is ground into fine particles by mixing-and-grinding apparatus, a mixing step 2 in which the fine particles thus formed are mixed with a predetermined amount of $Cr_3C_2$ powder, a granulating step 3 in which the powder mixture is granulated into particles of a predetermined particle size, a sintering step 4 in which the particles obtained by granulation are sintered, and a classifying step 5 in which particles having a particle size of 5 to 53 μm are sorted out.

In the mechanical alloying step 1, $Cr_3C_2$ powder is mixed with Ni powder and Cr powder and ground into finer particles in a mixing-and-grinding apparatus, thereby obtaining primary particle powder as described above.

The primary particle powder is fused in flame spray coating and binds $Cr_3C_2$ particles which are mixed with the primary particle powder in the mixing step 2.

In this particular embodiment, Ni powder and Cr powder which are separately powdered and have a particle size of not larger than 100 μm is mixed in the ratio of 4:1, and $Cr_3C_2$ powder having a particle size of 100 μm is added to the mixture of the Ni powder and the Cr powder by 7% by volume. Then the mixture thus obtained is mixed and ground into powder having a primary particle size of not larger than 10 μm by a mixing-and-grinding apparatus. In this particular embodiment, ATTLITER (Mitsui-Miike kakoki; MAISE) is used as the mixing-and-grinding apparatus, and is operated at 120 rpm for 20 hours in order to obtain powder having a primary particle size of not larger than 10 μm.

The $Cr_3C_2$ powder added to the Ni powder and the Cr powder is hard and promotes fining the Ni powder, the Cr powder and itself, thereby making it possible to grind the particles of the powders into very fine particles in a short time. Instead of the $Cr_3C_2$ powder, other powder such as hard graphite powder which is hard and brittle, and can promote fining the Ni powder and the Cr powder and suppress penetration of fused Ni and Cr into the metal phase of $Cr_3C_2$.

In the mixing step 2, $Cr_3C_2$ powder for forming flame spray coating is added to the primary particle powder which is obtained by the mechanical alloying step 1 and has a primary particle size of not larger than 10 μm, and is mixed therewith. In this particular embodiment, the particler size of the $Cr_3C_2$ powder is not larger than 10 μm and the $Cr_3C_2$ powder is added to the primary particle powder in the ratio of 75:25 by weight. The $Cr_3C_2$ powder added to the primary particle powder in this step forms an effective component which contributes to the hardness of the flame spray coating to be obtained.

In the mixing step 2, the $Cr_3C_2$ powder may be mixed with the primary particle powder by introducing the $Cr_3C_2$ powder into the mixing-and-grinding apparatus used in the mechanical alloying step 1, though it may be mixed with the primary particle powder by the use of a separate apparatus. In this particular embodiment, the $Cr_3C_2$ powder is introduced into the mixing-and-grinding apparatus used in the mechanical alloying step 1 and mixed with the primary particle powder in the apparatus for 2 hours at 200 rpm.

The granulating step 3 is a step for granulating the powder obtained by the mixing step 2 into secondary particles having a size suitable for flame spray coating. The granulating step is effected with binder added to the powder. In this particular embodiment, phenol resin is used as the binder and added to the powder by about 5% by weight. As the binder, other resins which can be burnt out during the sintering step 4 may be used. When the phenol resin is more than 5 wt %, shape of the particles cannot be maintained, and when the phenol resin is less than 5 wt %, the binding force is poor and the secondary particles cannot be formed.

The sintering step 4 is a step for sintering the secondary particle powder obtained by the granulating step 3. In this particular embodiment, the secondary particle powder is sintered for 5 hours at 1000° to 1200° C. in $H_2$ atmosphere. The sintering is effected in $H_2$ atmosphere so that the $Cr_3C_2$ powder is not oxidized.

After the sintering, the powder is classified by use of a vibrating screen (applied to the maximum particle size) or an air classifier (applied to the minimum particle size), and particles having a particle size of 5 to 53 μm are sorted out. When the particle size is smaller than 5 μm, the powder cannot easily enter plasma flame, and both the BET value and the porosity (which will be described later) are deteriorated. On the other hand, when the particle size is larger than 53 μm, the fusibility of the powder is deteriorated and the porosity is deteriorated.

EXAMPLE 1

Three types of flame spray coating powders (first to third embodiments) were prepared in accordance with the embodiment described above, and four different types of flame spray coating powders were prepared as controls (first to fourth controls). The powders were plasma-sprayed on a surface of an aluminum alloy cast article by is of a 7MB-model gun available from Meteco (U.S.A.) under the following conditions.

arc gas; Ar gas only
current; 1000 A
voltage; 43 V
distance; 65 mm.

The powders of first to third embodiments were plasma-sprayed so that fused Ni.Cr covered non-fused $Cr_3C_2$ particles to bind the particles and the thickness of one Ni.Cr layer was not larger than 5 μm. The film properties (hardness and porosity) of the spary coatings thus obtained were evaluated. The result is shown in table 1. The composition of the respective spray coating powders and properties of the primary particles of the respective spray coating powders were as shown in table 1. The first control was obtained by reducing the amount of $Cr_3C_2$ powder added to the Ni power and the Cr powder in the mechanical alloying step 1 (0.2 vol %), the second control was obtained by increasing the amount of $Cr_3C_2$ powder (15 vol %), the third control was obtained by lowering the sintering temperature in the sindering step 4 (800° to 1000° C.), and the fourth control was formed by use of Ni-Cr alloy powder in accordance with the conventional method.

The target value of the hardness was not lower than Hv 700 in Vickers hardness under load of 200 g, and the target value of the porosity was not larger than 2%. When Vickers hardness is lower than Hv 700, the hardness is unsatisfactory. When the porosity is larger than 3%, the wear resistance of the coating is unsatisfactory in the case where the spray coating powder is used for coating the lip of an oil seal in a side housing of a Wankel engine, for instance.

The size of the primary particles of the metal phase after the mechanical alloying step 1 was the maximum size of the primary particles as measured by use of a Coulter Counter available from Coulter Electronics U.S.A. The porosity was obtained by calculating the rate of the area of the pores by image analysis of the cross-section of the coating.

TABLE 1

| | composition | | | primary powder | | film properties | |
|---|---|---|---|---|---|---|---|
| | $Cr_3C_2$ (%) | Ni—Cr (%) | primary particle size (%) | $Cr_3C_2$ (vol %) | particle size (max; μm) | hardness (Hv; 200 g) | porosity (%) |
| 1st emb. | 75 | — | 25 | 7 | 9 | 750 | 1.8 |
| 2nd emb. | 75 | — | 25 | 10 | 10 | 735 | 1.9 |
| 3rd emb. | 75 | — | 25 | 0.5 | 10 | 704 | 1.7 |
| 1st contr. | 75 | — | 25 | 0.2 | 13 | 608 | 3.5 |
| 2nd contr. | 75 | — | 25 | 15 | 14 | 407 | 9.6 |
| 3rd contr. | 75 | — | 25 | 7 | 9 | 614 | 7.5 |
| 4th contr. | 75 | 25 | — | — | 35 | 525 | 5.6 |
| | target value | | | 0.5-10% | ≦10 μm | 700≦ | ≦2% |

As can be understood from table 1, the spray coatings formed by the spray coating powders of the first to third embodiments of the present invention exhibited excellent film properties and satisfied the target values in both the hardness and the porosity.

In the case of the spray coating formed by the spray coating powder of the first control, it satisfied the target values neither in the hardness nor in the porosity. It may be considered that this is because the primary particle size was too large since the amount of $Cr_3C_2$ added to the Ni powder and the Cr powder in the mechanical alloying step 1 was small and the grinding could not be satisfactorily effected.

In the case of the spray coating formed by the spray coating powder of the second control, it also satisfied the target values neither in the hardness nor in the porosity. It may be considered that this is becuase the primary particle size was too large due to large amount of $Cr_3C_2$ added to the Ni powder and the Cr powder.

In the case of the coating formed by the powder of the third control, it may be considered that the film properties were deteriorated due to poor intergranular binding force resulting from low sintering temperature.

In the case of the coating formed by the powder of the fourth control, the film properties were inferior due to large primary particle size as described above.

EXAMPLE 2

The seal sliding surface on the side housing of a Wankel engine was provided with $Cr_3C_2$ coating by use of various flame spray coating powders.

Figure 2:
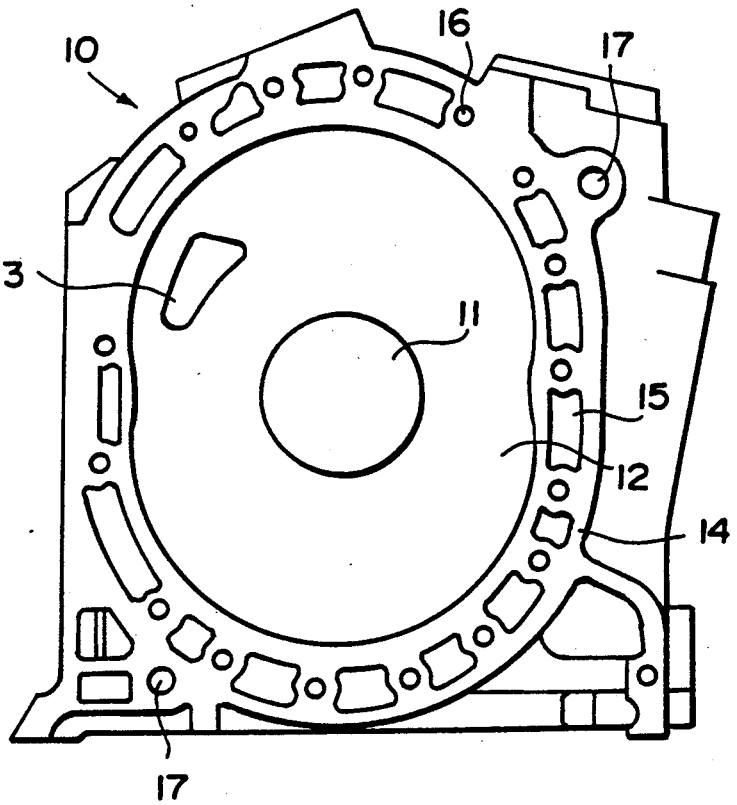
FIG. 2 is a plan view of a side housing.

FIG. 2 shows the side housing used in this example. In FIG. 2, the side housing 10 forms a rotor chamber together with a rotor housing (not shown) for accommodating a rotor. The side housing 10 is provided with a shaft receiving hole 11 into which the eccentric shaft of the rotor is inserted. A seal sliding surface 12 on which a seal member of the rotor slides is formed around the shaft receiving hole 11. A side intake port 13 opens in the seal sliding surface 12. On the outer side of the seal sliding surface 12, there is provided a joint surface 14 against which the joint surface of the rotor housing abuts. Coolant passages 15 for flowing cooling water, tension bolt insertion holes 16 and locator bolts insertion holes 17 are formed in the joint surface 14.

On the seal sliding surface 12, the flame spray coating was provided by use of various flame coating powders.

When the side housing 10 is manufactured, the part of the side housing (which is made of aluminum alloy, e.g., AC 4A) corresponding to the seal sliding surface 12 is first recessed to a predetermined depth below the joint surface 14. Then the recessed part is degreased and is subjected to shot blusting. Thereafter, the recessed part is provided with a coating by plasma spray coating of spraying powder with the joint surface 14 masked. The spray coating layer thus formed is roughly ground and precisely ground by use of diamond tools into a coating of 150 μm thick.

A plurality of side housings were provided on the respective seal sliding surfaces 12 with flame spray coating with the primary particle size, the secondary particle size, the proportion of Ni.Cr in the powder, the spraying conditions and the like changed from coating to coating, and the film properties of the respective coatings were evaluated. Further, the side housings provided with the coatings were incorporated in engines and the wear resistance of the coatings were tested while the engines were operated. Result of evaluation and the test were shown in table 2. With respect to the BET value, some coatings were formed on predetermined sample materials as will be described in detail later.

In table 2, the first control was obtained by reducing the amount of Ni.Cr binder (10%). The second control was obtained by increasing the amount of Ni.Cr binder (50%). The third control was obtained by effecting spray coating under the conventional conditions in which also the $Cr_3C_2$ particles were fused. The fourth control was obtained by spray coating of spray coating powder in which the size of the $Cr_3C_2$ particles in the primary particles was relatively large (maximum size of 19 μm). The fifth control was obtained by spray coating of spray coating powder in which the size of the Ni.Cr particles in the primary particles was relatively large (maximum size of 18 μm). The sixth control was obtained by spray coating of spray coating powder in which the secondary particle size was relatively large (maximum size of 74 μm) under the following conditions.

arc gas; $Ar+H_2$
current; 500 A
voltage; 65 V
distance; 65 mm.

The seventh control was obtained by spray coating of spray coating powder in which the secondary particle size was relatively small (minimum size of 2 μm). The eighth control was obtained by effecting spraying coating under the following conditions.

arc gas; Ar gas only
current; 950 A
voltage; 40 V
distance; 65 mm
thickness of the Ni.Cr layer; maximum 6 μm.

In the ninth embodiment, the spray coating layer was composed of Wc-Co. The tenth control was obtained by gas spray coating of Mo. The eleventh control was composed of a cast iron softening layer instead of a flame spray coating layer.

In all the embodiments and the controls except the sixth, eighth and eleventh controls, the spray coatings were formed by the same plasma spray coating apparatus as used in the Example 1.

The specifications of the Wankel engine used in this test and the testing conditions were as follows.

Engine specifications

13 B (1300 cc) two-rotor Wankel engine with a turbocharger

Testing conditions (1) operation at 1500 rpm under no load: 20 seconds
(2) operation at 7000 rpm under full load with the throttle wide open: 1.25 minutes Steps (1) and (2) were effeted in sequence as one cycle and 9000 cycles were repeated.

In table 2, BET represents the rate of reduction in volume during blast erosion test. This test was effected substantially in accordance with "Method of testing inter-particle bond" in "Method of testing padding-spray-coated article" (JIS H 8664), and the testing conditions were as follows.

blasting apparatus: pressure blast machine
blast material: alundum system #60
nozzle diameter: 5 mm
distance: 100 mm
blasting pressure: 3 $Kg/cm^2$
blasting time: 10 seconds
blasting angle: 30°
sample size: 50×60×5 steel piece
thickness of spray coating: 300 μm.

Figure 3:
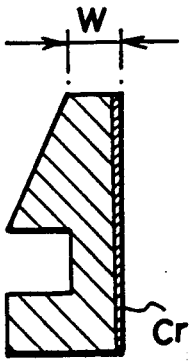
FIG. 3 is a cross-sectional view of an oil seal.

The oil seal used in the lip wear test was formed of alloyed cast iron (C:3.7 wt %, Si:2.5 wt %, Mn:0.7 wt %, P:0.4 wt %, S:0.12 wt %, B0.05 wt %, Fe:residue) plated with Cr. The lip wear of the oil seal was represented by increase in the width W (FIG. 3) of the top surface of the oil seal due to wear.

"Stepped wear by side seal" represented the wear in the part of a minor side of the hot zone side of the trochoidal housing. At this part, since the side seal moves in the longitudinal direction, wear is more than the other part and this part is stepped by wear. The height of the step was meaured.

"Film structure" was obtained through image analysis of photographs and through visual inspection through an optical microscope.

The target value of the hardness was set to be not lower than Hv 750 in Vickers hardness under load of 200 g, the target value of the porosity was set to be not larger than 2%, and the target value of BET was set to be not larger than 50 $mm^3$ in view of increasing requirements for the seal sliding surface of the side housing of Wankel engines made of aluminum alloy. When these target values are cleared, the lip wear of oil seal will be not larger than 0.38 mm, and the stepped wear by side seal will be not larger than 20 μm.

TABLE 2

| | POWDER | | | | FILM STRUCTURE | | | |
|---|---|---|---|---|---|---|---|---|
| | $Cr_3C_2$ PRIM. SIZE (μ) | NiCr PRIM. SIZE (μ) | SEC. SIZE (μ) | NiCr (%) | MELT | $Cr_3C_2$ THICK-NESS (μ) | NiCr THICK-NESS (μ) | $Cr_3C_2$ AREA (%) |
| 1st EMB. | 10< | 10< | 10-53 | 25 | NiCr | 10< | 5< | 79 |
| 2nd EMB. | 10< | 10< | 10-53 | 15 | NiCr | 10< | 5< | 86 |
| 3rd EMB. | 10< | 10< | 10-53 | 40 | NiCr | 10< | 5< | 65 |
| 1st CONTR. | 10< | 10< | 10-53 | 10 | NiCr | 10< | 5< | 92 |
| 2nd CONTR. | 10< | 10< | 10-53 | 50 | NiCr | 10< | 5< | 53 |
| 3rd CONTR. | 10< | 10< | 10-53 | 25 | $Cr_3C_2$ + NiCr | 10< | 5< | 78 |
| 4th CONTR. | 19< | 10< | 10-53 | 25 | NiCr | 13< | 5< | 79 |
| 5th CONTR. | 10< | 18< | 10-53 | 25 | NiCr | 10< | 11< | 78 |
| 6th CONTR. | 10< | 10< | 10-74 | 25 | NiCr | 10< | 5< | 79 |
| 7th CONTR. | 10< | 10< | 2-53 | 25 | NiCr | 10< | 5< | 78 |
| 8th CONTR. | 10< | 10< | 10-53 | 25 | NiCr | 10< | 6< | 79 |
| 9th CONTR. | Wc-Co | | | | — | — | — | — |
| 10th CONTR. | Mo GAS | | | | — | — | — | — |
| 11th CONTR. | CAST IRON GAS SOFTENING LAYER | | | | — | — | — | — |

| | FILM PROPERTIES | | | OIL SEAL LIP WEAR (mm) | STEPPED WEAR BY SIDE SEAL (μ) | NOTE |
|---|---|---|---|---|---|---|
| | BET ($mm^2$) | POROSITY (%) | HARD-NESS (Hv: 200 g) | | | |
| 1st EMB. | 47 | 1.6 | 790 | 0.30 | 12 | working time 3 min. |
| 2nd EMB. | 50 | 2.0 | 800 | 0.36 | 18 | |
| 3rd EMB. | 42 | 1.5 | 751 | 0.38 | 19 | |

TABLE 2-continued

| | | | | | | |
|---|---|---|---|---|---|---|
| 1st CONTR. | 76 | 3.8 | 720 | 0.86 | 52 | |
| 2nd CONTR. | 40 | 1.4 | 586 | 0.95 | 48 | |
| 3rd CONTR. | 75 | 4.9 | 680 | 13 | 72 | |
| 4th CONTR. | 53 | 2.9 | 712 | 0.74 | 38 | |
| 5th CONTR. | 58 | 2.7 | 735 | 0.62 | 51 | |
| 6th CONTR. | 51 | 3.0 | 740 | 0.58 | 48 | |
| 7th CONTR. | 64 | 2.8 | 702 | 0.71 | 63 | |
| 8th CONTR. | 46 | 2.1 | 740 | 0.47 | 30 | |
| 9th CONTR. | 48 | 1.6 | 826 | 0.31 | 11 | working time 60 min. |
| 10th CONTR. | 72 | 7.5 | 880 | 0.64 | 105 | |
| 11th CONTR. | — | — | — | 0.60 | 28 | |

As can be understood from table 2, the first to third embodiments all satisfied the traget values on the porosity (not larger than 2%), the hardness (not lower than 750) and the BET (not larger than 50 $MM^3$) (The rate of the area of the $Cr_3C_2$ was not smaller than 65% at this time.), and both the lip wear of the side seal and the stepped wear by the side seal were less in the first to third emodiments than in the ninth to eleventh controls. Further the working time is substantially shortened in the case of the first embodiment as compared with in the case of the Wo-Co coating (the ninth control).

That is, the side housing of the Wankel engine made of aluminum alloy the seal sliding surface of which is provided with highly durable flame spray coating can be manufactured at low cost.

The first control was inferior in both the value of BET and the porosity, which resulted in increased lip wear of the oil seal and increased stepped wear by the side seal. It may be considered that this is because of poor binding force resulting from small amount of binder, e.g., Ni.Cr.

The second control was inferior in hardness though superior in both the value of BET and the porosity due to large amount of Ni.Cr. As a result, the lip wear and the stepped wear were both increased.

The third control was inferior in both the porosity and the hardness due to increased pores, and as a result, the lip wear and the stepped wear were both increased. This may be because the $Cr_3C_2$ particles were fused.

In the fourth control, the binding power was poor due to large particle size of the $Cr_3C_2$ particles and accordingly, the value of BET was inferior.

In the fifth control, the Ni.Cr particles were not satisfactorily fused upon flame spraying due to large particle size, which resulted in poor $Cr_3C_2$ particle binding power and inferior value of BET and the porosity.

In the sixth control, the secondary particles were not satisfactorily fused upon flame spray coating due to large particle size of the secondary particles, which resulted in inferior values of BET and the porosity.

In the seventh control, the secondary particle size was too small for the secondary particles to satisfactorily enter plasma, which resulted in inferior porosity.

In the eighth control, the porosity was increased and the hardness was lowered. This may be due to the thickness of Ni.Cr layer which was larger than 5 μm (6 μm).

We claim:

1. A method of manufacturing a flame-spray-coated article comprising steps of adding hard particles containing carbide to mixture of Ni powder and Cr powder, grinding the hard particles and powder mixture thus obtained into powder the primary particle size of which is not larger than 10 μm, mixing the powder mixture with a predetermined amount of $Cr_3C_2$ powder having a predetermined particle size, granulating and sintering the mixture thus obtained to obtain flame spray coating powder and flame-spraying the flame spray coating powder onto an article under conditions which will cause fused Ni.Cr to cover $Cr_3C_2$ particles which are not fused, thereby binding the $Cr_3C_2$ particles.

2. A method as defined in claim 1 in which phenol resin is added as a binder when the mixture of the powder mixture and $Cr_3C_2$ powder is granulated.

3. A method as defined in claim 1 in which said sintering is effect at 1000° to 1200° C. for 15 hours in hydrogen atmosphere.

4. A method as defined in claim 1 in which particles having a size of 5 to 53 μm are sorted out.

5. Method of manufacturing flame spray coating powder comprising steps of adding hard particles containing carbide to mixture of Ni powder and Cr powder, grinding the hard particles and powder mixture thus obtained into powder the primary particle size of which is not larger than 10 μm, mixing the powder mixture with $Cr_3C_2$ powder having a predetermined particle size, and granulating and sintering the mixture thus obtained.

6. A method as defined in claim 5 in which phenol resin is added as a binder when the mixture of the powder mixture and $Cr_3C_2$ powder is granulated.

7. A method as defined in claim 5 in which said sintering is effected at 1000° to 1200° C. for 15 hours in hydrogen atmosphere.

8. A method as defined in claim 5 in which particles having a size of 5 to 53 μm are sorted out.

* * * * *